US012213544B2

(12) United States Patent
Noble

(10) Patent No.: US 12,213,544 B2
(45) Date of Patent: Feb. 4, 2025

(54) PROTECTIVE GARMENT SYSTEM

(71) Applicant: 5.11, Inc., Manteca, CA (US)

(72) Inventor: Matthew David Noble, Long Beach, CA (US)

(73) Assignee: 5.11, Inc., Manteca, CA (US)

( * ) Notice: Subject to any disclaimer, the term of this patent is extended or adjusted under 35 U.S.C. 154(b) by 243 days.

(21) Appl. No.: 17/303,993

(22) Filed: Jun. 11, 2021

(65) Prior Publication Data

US 2021/0386131 A1 Dec. 16, 2021

Related U.S. Application Data

(60) Provisional application No. 63/038,342, filed on Jun. 12, 2020.

(51) Int. Cl.
*A41D 13/05* (2006.01)
*A41D 13/06* (2006.01)

(52) U.S. Cl.
CPC ..... *A41D 13/0562* (2013.01); *A41D 13/05* (2013.01); *A41D 13/065* (2013.01)

(58) Field of Classification Search
CPC ..... A41D 13/05–088
See application file for complete search history.

(56) References Cited

U.S. PATENT DOCUMENTS 4,593,416 A * 6/1986 Figgie, III ..... A41D 13/0568 2/24
5,557,804 A * 9/1996 Ovortrup ..... A63B 71/1225 2/467
6,253,376 B1 * 7/2001 Ritter ..... A41D 13/065 2/24
7,237,270 B2 * 7/2007 Crye ..... A41D 13/0575 2/24
7,712,150 B2 * 5/2010 Pardillo ..... A41D 13/0556 2/23
7,975,634 B1 * 7/2011 Dugan ..... A41D 13/065 2/24
11,191,309 B1 * 12/2021 McCusker ..... A41D 13/0575
2004/0221353 A1 * 11/2004 Kennard ..... A41D 13/065 2/24
2005/0268370 A1 * 12/2005 Frieler ..... A41D 13/0562 2/24
2006/0005292 A1 * 1/2006 Crye ..... A41D 13/0575 2/24
2006/0277644 A1 * 12/2006 Dobkin ..... A41D 13/015 2/24
2010/0223709 A1 * 9/2010 Crye ..... A41D 13/0581 2/24

(Continued)

*Primary Examiner* — Katharine G Kane
(74) *Attorney, Agent, or Firm* — VIA LLP

(57) ABSTRACT

A protective garment system includes a garment base and at least one protective element that is removably engageable with the garment base. In some configurations, a first protective element comprises a plurality of attachment or anchor features that interact with the garment base or another portion of the system to partially or fully engage the first protective element in a removable manner with the garment base. In addition or in the alternative, the protective garment can include a second protective element that is removably engageable with the garment base separately from the first protective element. The protective elements can be a knee cap and a knee pad.

22 Claims, 14 Drawing Sheets

(56) References Cited

U.S. PATENT DOCUMENTS

| | | | | |
|---|---|---|---|---|
| 2010/0235960 | A1* | 9/2010 | Johnson | A41D 13/065 2/24 |
| 2011/0252548 | A1* | 10/2011 | Weiss | A41D 13/05 2/455 |
| 2012/0131729 | A1* | 5/2012 | Hernandez | A41D 13/0575 2/24 |
| 2012/0311755 | A1* | 12/2012 | Neuron | A41D 1/06 2/24 |
| 2014/0215679 | A1* | 8/2014 | Habip | A41D 13/0506 2/23 |
| 2014/0304900 | A1* | 10/2014 | Sugano | A41D 13/0575 2/455 |
| 2017/0065007 | A1* | 3/2017 | Picone | A41D 13/0556 |
| 2017/0086515 | A1* | 3/2017 | Ruiz | A41D 13/0575 |
| 2018/0132549 | A1* | 5/2018 | Pratson | A41D 13/0158 |
| 2018/0292173 | A1* | 10/2018 | Roby | F41H 1/00 |

* cited by examiner

PROTECTIVE GARMENT SYSTEM

BACKGROUND

Field

The present disclosure relates to protective garments. In particular, the present disclosure relates to a protective garment having one or more removable protective elements.

Description of the Related Art

Protective garments can include protective elements to protect an underlying anatomical region of a user of the garment. For example, protective garments can include protective elements for the user's knee.

SUMMARY

The systems, methods and devices described herein have innovative aspects, no single one of which is indispensable or solely responsible for their desirable attributes. Without limiting the scope of the claims, some of the advantageous features will now be summarized.

An aspect of the present disclosure involves a protective garment system having a garment base and at least a first protective element that is removably engageable with the garment base. The first protective element includes a plurality of anchors configured to couple the first protective element in a removable manner relative to the garment base.

In some configurations, the first protective element is a rigid cap.

In some configurations, each of the plurality of anchors comprises one or more hooks.

In some configurations, the first protective element engages the garment base at discrete regions of a perimeter of the first protective element.

In some configurations, a second protective element that is a pad.

In some configurations, the first protective element and the second protective element are separated by a layer of the garment base.

In some configurations, the first protective element is directly coupled to the second protective element.

An aspect of the present disclosure involves a protective garment system including a garment base, a first protective element and a second protective element. The first protective element is removably engageable with the garment base. The second protective element is removably engageable with the garment base. The second protective element is removably engageable with the garment base separately from the first protective element.

In some configurations, the first protective element is a rigid cap.

In some configurations, the first protective element comprises a plurality of anchors that engage the garment base.

In some configurations, each of the plurality of anchors comprises one or more hooks.

In some configurations, the first protective element engages the garment base at discrete regions of a perimeter of the first protective element.

In some configurations, the second protective element is a pad.

In some configurations, the first protective element and the second protective element are separated by a layer of the garment base.

An aspect of the present disclosure involves a protective garment system including a garment base, a first protective element and a second protective element. The second protective element is removably engageable with the garment base. The first protective element is removably engageable with the second protective element such that the first protective element is secured relative to the garment base when engaged with the second protective element.

In some configurations, the first protective element is a rigid cap.

In some configurations, the first protective element comprises a plurality of anchors that engage the second protective element.

In some configurations, each of the plurality of anchors comprises one or more hooks, a clip, or a portion of a hook and loop fastener.

In some configurations, the first protective element passes through openings in the garment base located at discrete regions of a perimeter of the first protective element.

In some configurations, at least a portion of the first protective element is located external of the garment base and at least a portion of the second protective element is located internal of the garment base.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION

Figure 1:
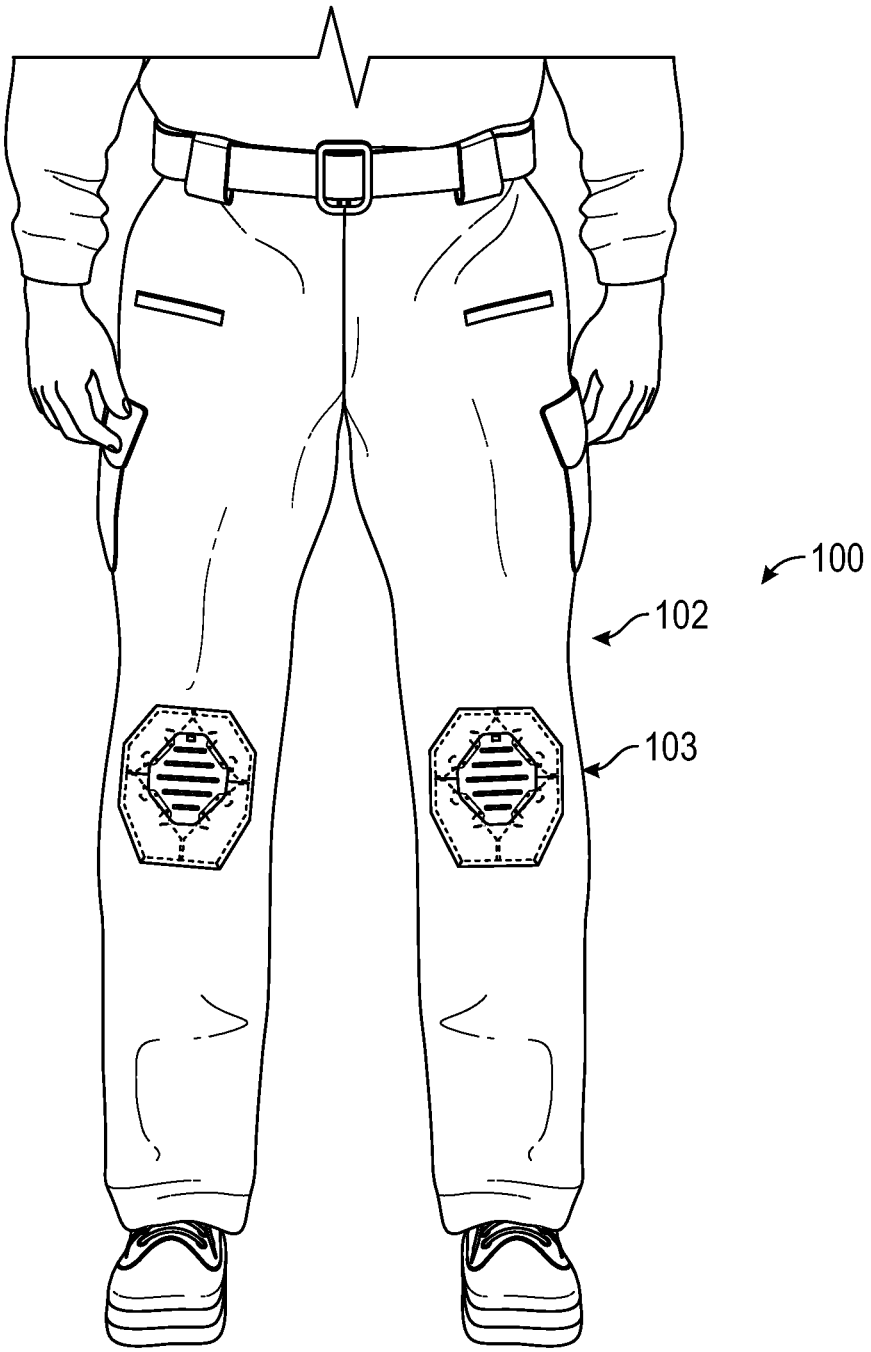
FIG. 1 is a front view of an embodiment of a protective garment system embodied in a pant.

Embodiments of systems, components and methods of assembly and manufacture will now be described with reference to the accompanying figures, wherein like numerals refer to like or similar elements throughout. Although several embodiments, examples and illustrations are disclosed below, it will be understood by those of ordinary skill in the art that the inventions described herein extend beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

FIGS. 1-11 illustrate a protective garment system 100 including a garment base 102 and at least one protective element that is removably engageable with the garment base 102. The illustrated protective garment system 100 is designed to protect the knee of a user or wearer of the garment base 102. Thus, the garment base 102 can be a lower body garment, such as a pair of pants or shorts. However, the protective garment system 100 can be configured to protect other anatomical regions of a user, such as an elbow, for example. Accordingly, the protective garment system 100 can be an upper body garment, such as a shirt or jacket, for example. The protective garment system 100 can be configured to protect any desirable anatomical region of a user (e.g., shoulder, chest, back, other part of the torso, thigh, shin, etc.). Accordingly, references to pants herein can be replaced with a shirt, jacket, shorts or other relevant garment. Similarly, references to the knee, knee pad or knee cap can be replaced with a reference to an elbow, shin or other anatomical body part to be protected.

Figure 4:
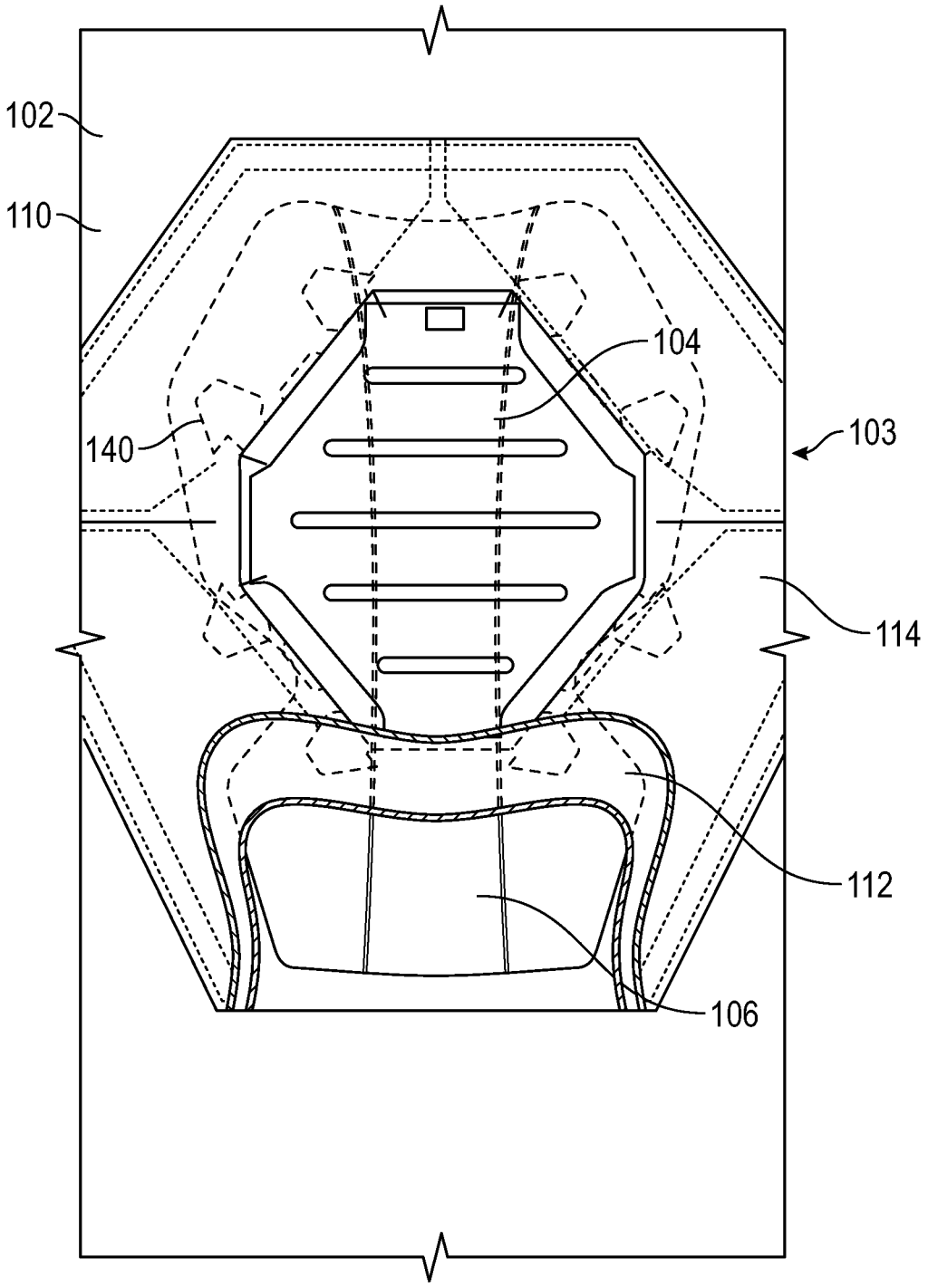
FIG. 4 is a front view of the knee portion of FIG. 2 with layers of the pant cut away to illustrate a knee pad.
Figure 7:
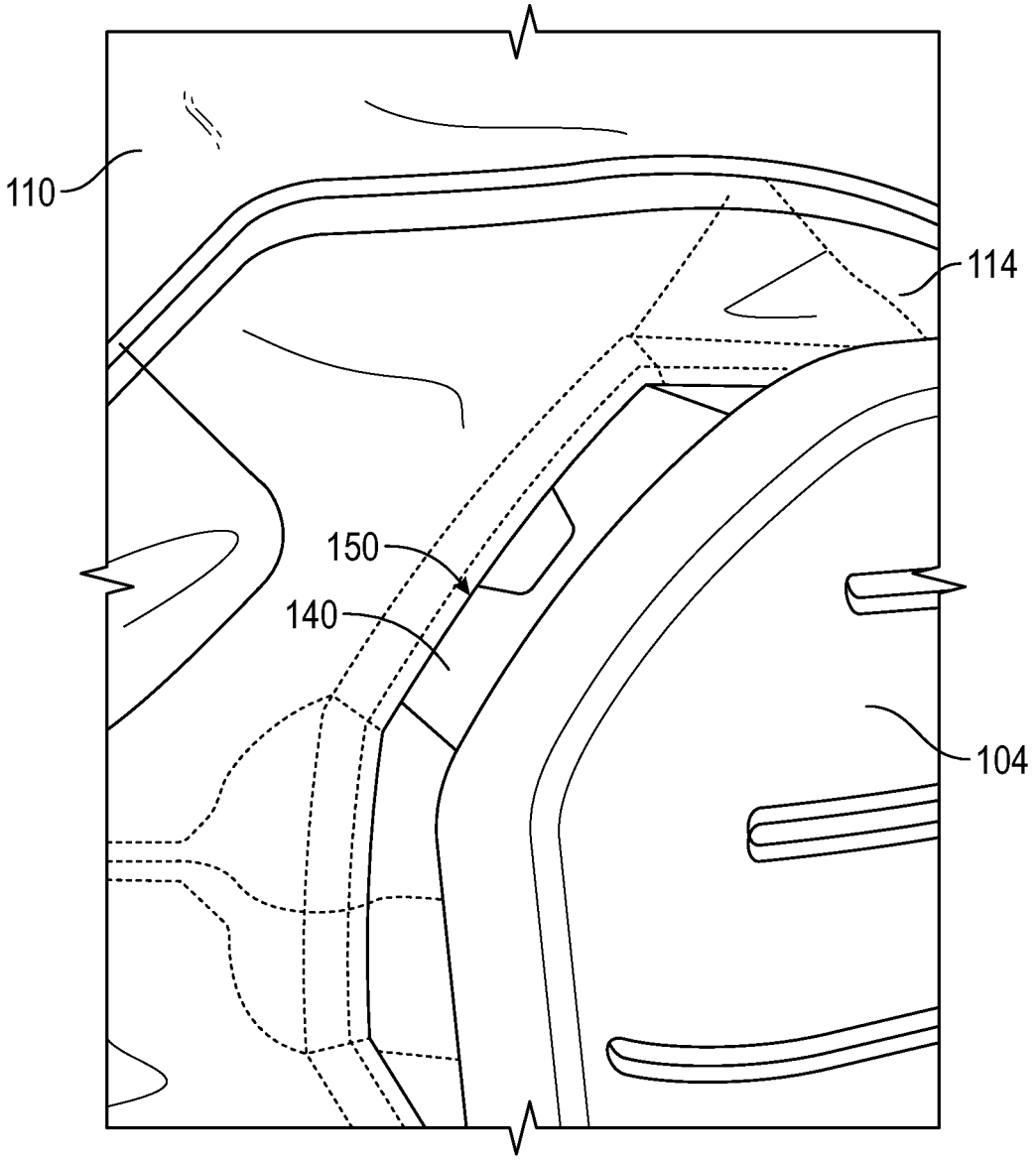
FIG. 7 is an enlarged view of the knee protection arrangement illustrating an interface between the knee cap and a pocket of the pant.
Figure 8:
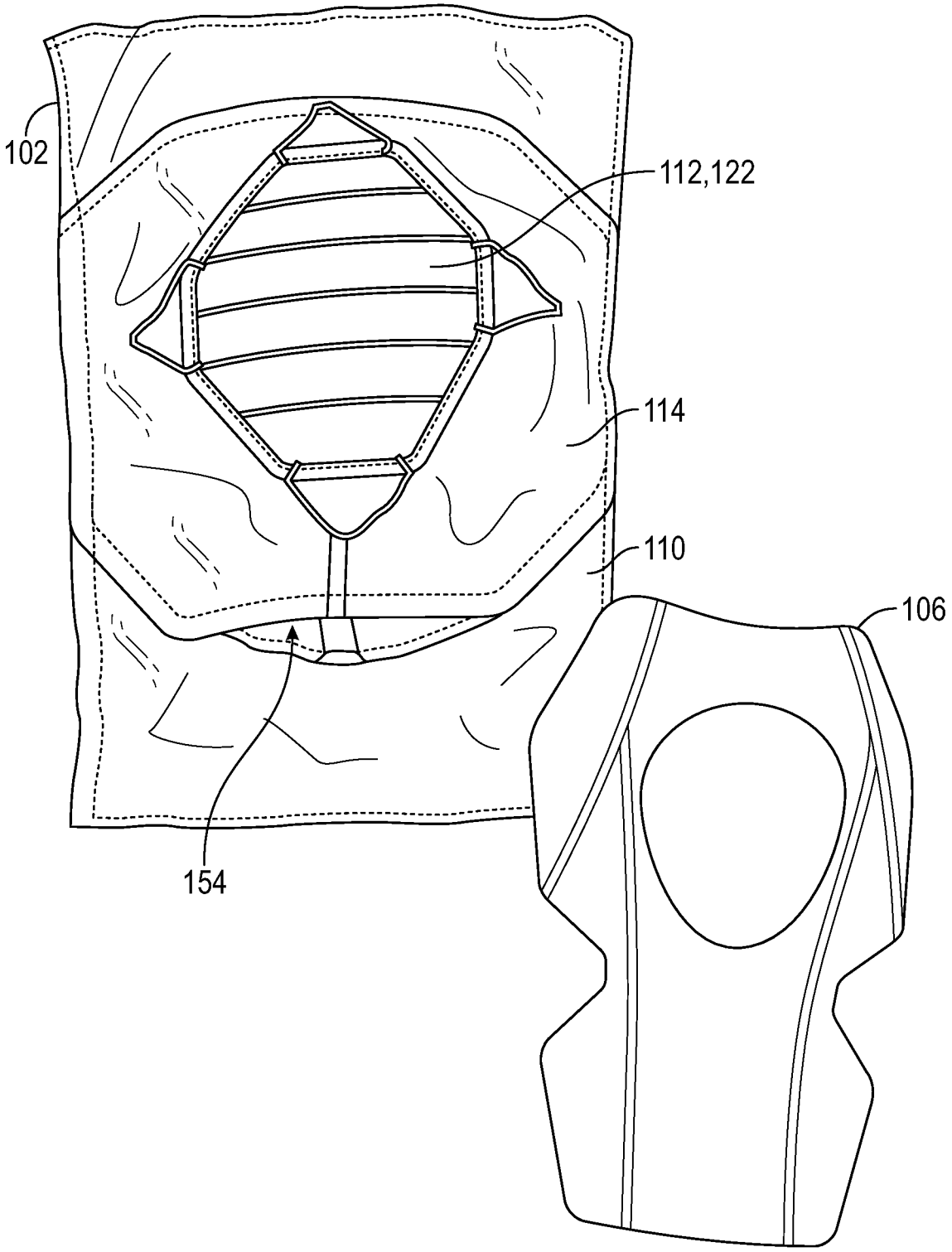
FIG. 8 illustrates the knee protection arrangement with the knee pad removed and illustrating an opening to the pocket through which the knee pad can be inserted and removed.
Figure 9:
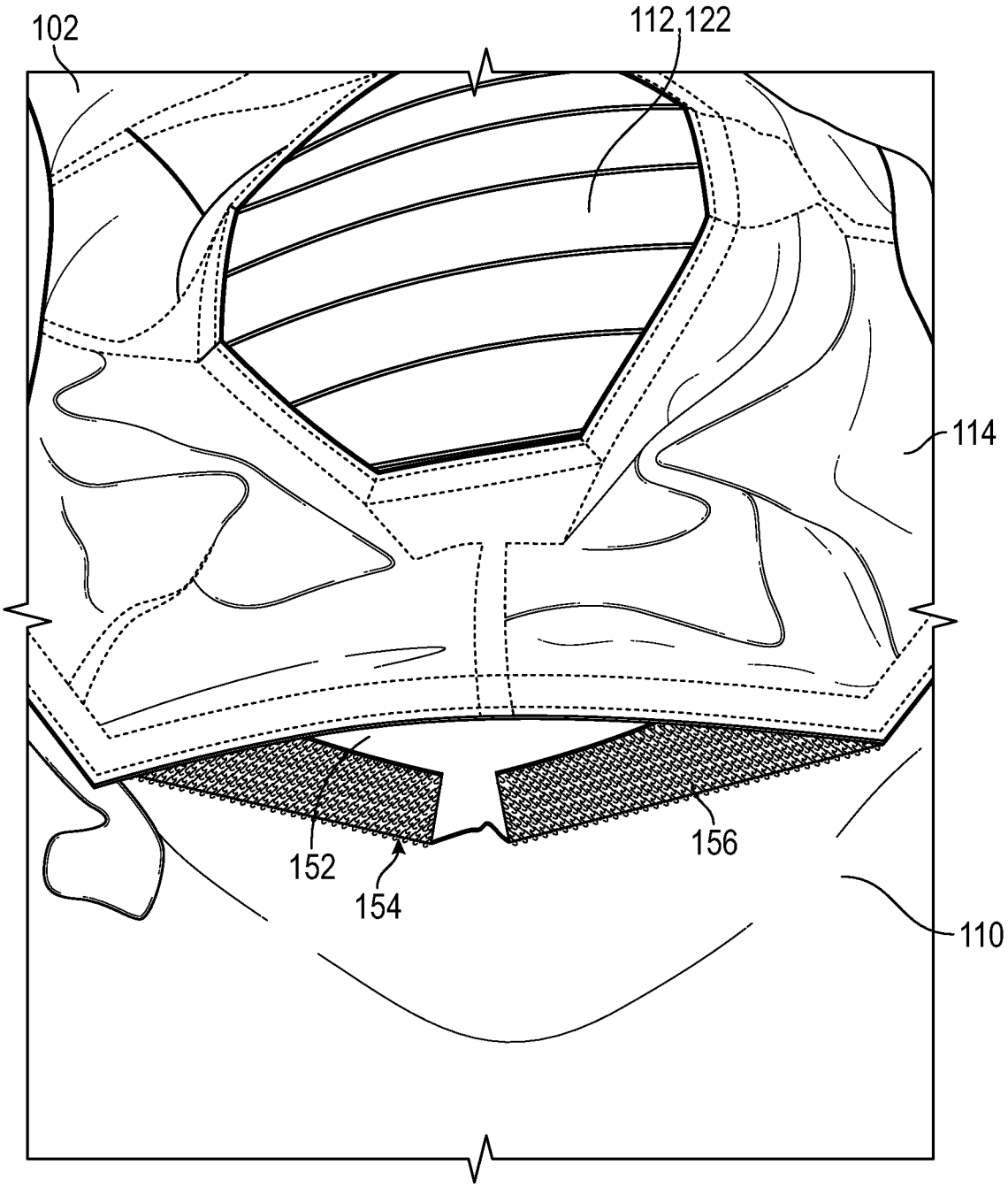
FIG. 9 is an enlarged view of the knee portion of the pant illustrating the opening to the pocket shown in FIG. 8.
Figure 10:
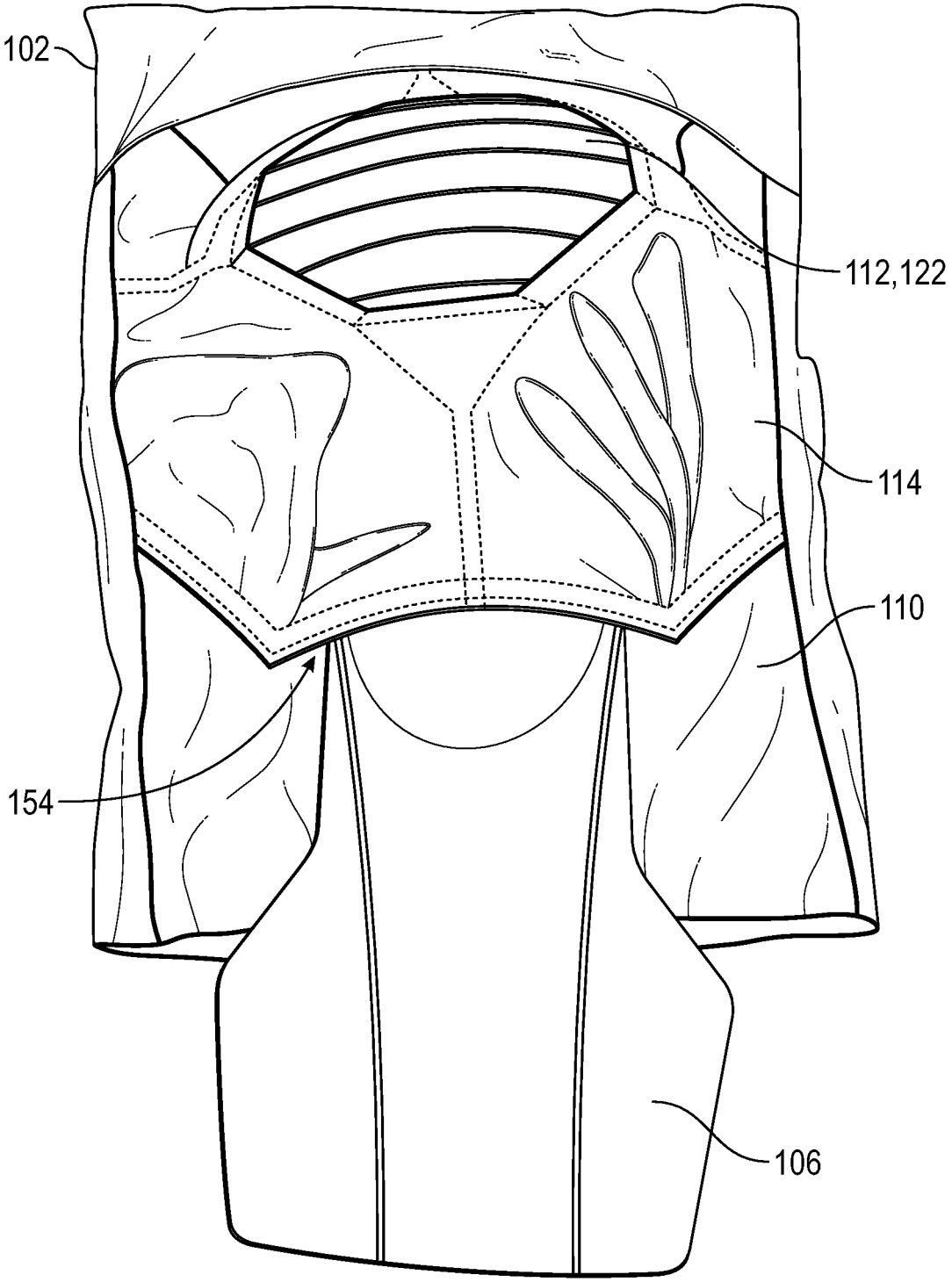
FIG. 10 illustrates the knee pad partially inserted into the pocket of the pant through the opening.

In the illustrated arrangement, the protective garment system 100 includes a protection arrangement 103 at least a first protective element 104 (FIGS. 2, 4 and 5-7) and a second protective element 106 (FIGS. 4, 8 and 10). In some arrangements, the first protective element 104 and the second protective element 106 can be used separately or together. In some alternative arrangements, only one of the protective elements 104, 106 can be provided. The first protective element 104 can be a knee cap. The second protective element 106 can be a knee pad. The knee cap 104 can be constructed from a more rigid material than the material of the knee pad 106. For example, the knee cap 104 can be constructed in whole or in part from a relatively rigid plastic or similar material and the knee pad 106 can be constructed in whole or in part from a foam or similar material.

In some configurations, the knee cap 104 and the knee pad 106 are removably engageable with the garment base 102 separately from one another. In some configurations, the knee cap 104 and the knee pad 106 are separated by a layer of the garment base 102. In the illustrated arrangement, the garment base 102 includes a first layer 110, which can be a layer that forms a portion or an entirety of the basic shape of the garment base 102. In other words, the first layer 110 can form a portion of the garment that would exist in the absence of the protective garment system 100.

The garment base 102 also includes at least one additional layer that is configured to engaged or be located adjacent to one or both of the knee cap 104 and the knee pad 106. In some configurations, the garment base 102 can include more than one additional layer, such as a second layer 112 and a third layer 114 (see, e.g., FIG. 4). Providing both a second layer 112 and a third layer 114 allows the knee cap 104 and the knee pad 106 to be completely separated from one another by one of the second layer 112 and the third layer 114.

In the illustrated arrangement, the second layer 112 and the third layer 114 cover a portion of the first layer 110, as shown in FIGS. 1-4, for example. The second layer 112 and the third layer 114 each define an outer perimeter 118. In the illustrated arrangement, the outer perimeters 118 of the second layer 112 and the third layer 114 match one another in size or shape. However, in other arrangements, the second layer 112 and the third layer 114 may have perimeters that vary in size and/or shape.

The second layer 112 is located between the first layer 110 and the third layer 114. The third layer 114 can define an outer surface of the garment base 102. In use, the knee pad 106 can be positioned in a space between the first layer 110 and the second layer 112 (see, e.g., FIG. 4). In use, at least a portion of the knee cap 104 (e.g., an attachment or anchoring feature, as described below) can be positioned in a space between the second layer 112 and the third layer 114 (see, e.g., FIG. 4). However, in other configurations, the knee pad 106 and at least a portion of the knee cap 104 can be located in the same space defined between layers of the garment base 102 (e.g., between the first layer 110 and the third layer 114 with the second layer 112 being omitted).

In the illustrated arrangement, the third layer 114 includes an interior opening 120 that exposes a portion of the second layer 112. Thus, the third layer 114 is generally annular in shape and defines an annular space with a portion of the second layer 112. The annular space receives an attachment or anchoring feature of the of the knee cap 104. Accordingly, the third layer 114 can be referred to herein as a bezel. The second layer 112 can include a padded patella portion 122 that is exposed through the opening 120 of the third layer 114. The padded patella portion 122 can be configured to overlie the user's patella or knee cap. The padded patella portion 122 can provide protection to the knee of the user in addition to or in the place of the knee cap 104 and/or knee pad 106.

Figure 5:
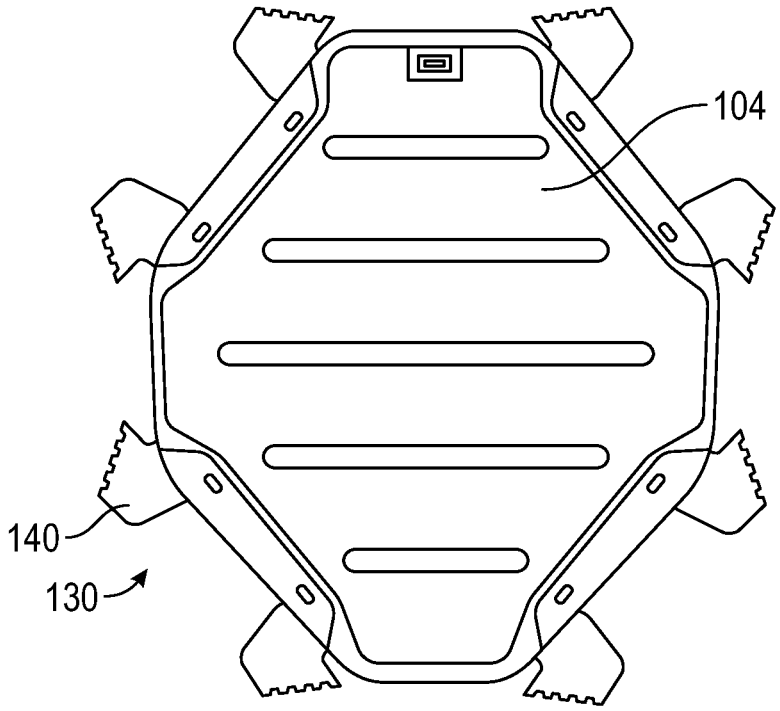
FIG. 5 is a front view of the knee cap of the knee protection arrangement of FIGS. 1-4.
Figure 6:
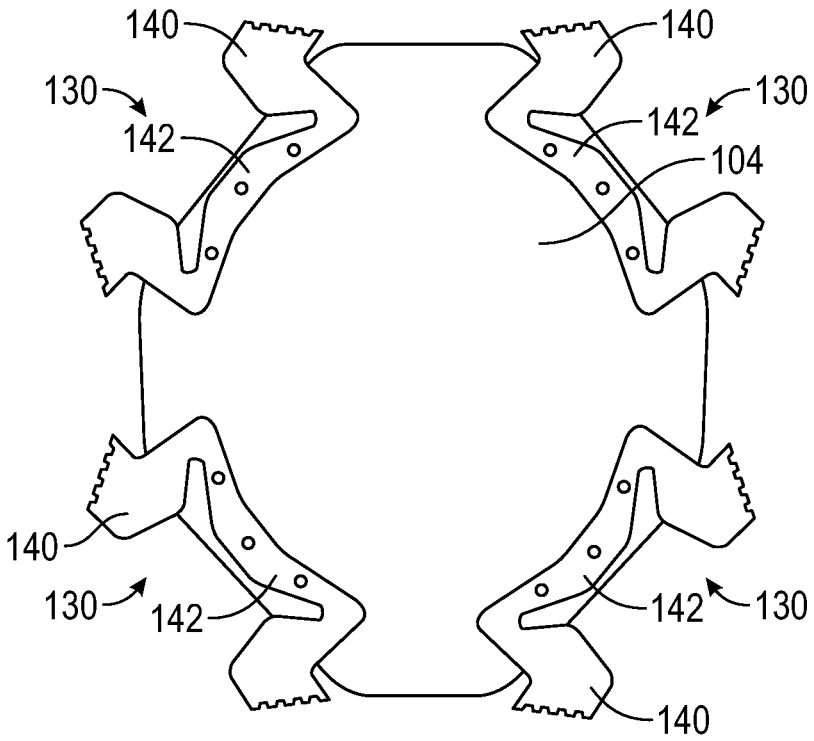
FIG. 6 is a rear view of the knee cap of FIG. 5.

FIGS. 5 and 6 illustrate the front and the rear of the knee cap 104, respectively, separate from the garment base 102. As discussed above, the knee cap 104 includes one or more an attachment or anchoring features or anchors 130 attached thereto. In the illustrated arrangement, the knee cap 104 includes four attachment or anchoring features 130. However, other number of attachment or anchoring features 130 may also be provided, such as one, two, three, five or more. Preferably, at least two attachment or anchoring features 130 are provided for improved retention and/or improved reliability of the retention of the knee cap 104 to the garment base 102. The attachment or anchoring features 130 can be constructed in whole or in part by a relatively flexible and resilient polymer, such as an elastomer.

In some configurations, each of the attachment or anchoring features 130 comprises at least one prong or hook 140. In the illustrated arrangement, each of the attachment or anchoring features 130 includes a pair of hooks 140 connected by a base 142. The base 142 can extend along a perimeter of body of the knee cap 104. Each of the hooks 140 extend outwardly from the base 142 such that a maximum width of the hooks 140 is greater than a width of the base 142. The base 142 is connected to the knee cap 104 and the hooks 140 are movable relative to the knee cap 104. The base 142 can be connected to the knee cap 104 by any suitable arrangement, such as mechanical fastening, adhesives, or a suitable welding process (e.g., ultrasonic, laser, or vibration welding).

The hooks 140 can be movable toward one another. The hooks 140 can move as a result of flexing permitted by the resiliency of the material(s) from which the hooks 140 are constructed. A transition between the base 142 and the hooks 140 can be a localized thin region to encourage flexibility to occur at the transition when the hooks 140 move relative to the base 142. Other suitable arrangements can also be used to facilitate desired flexibility of the hooks 140 relative to the base 142. In the illustrated arrangement, each of the attachment or anchoring features 130 is symmetrical about an axis passing between the hooks 140.

Figure 3:
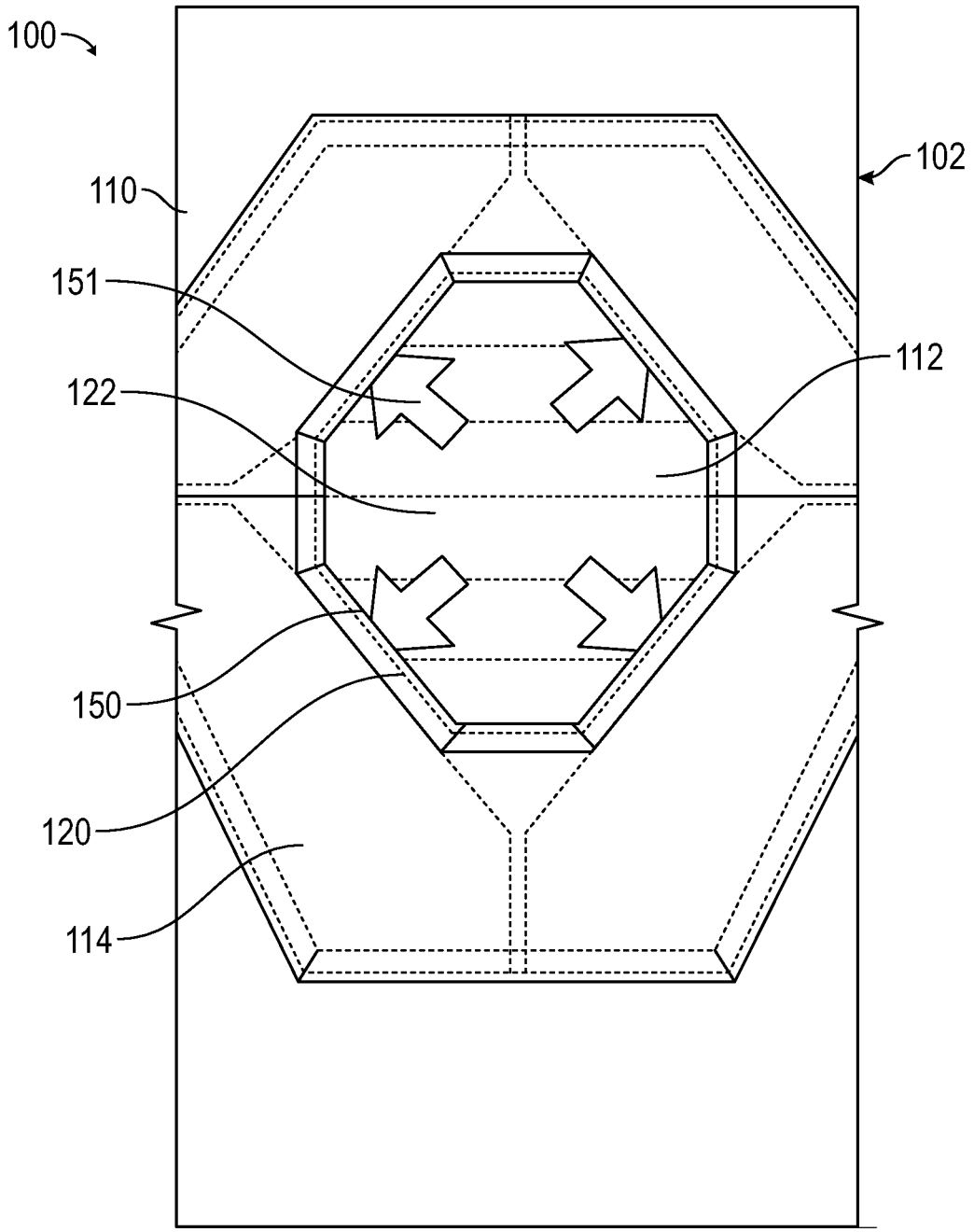
FIG. 3 is a front view of the knee portion of FIG. 2 with a knee cap removed.

With reference to FIG. 3, the bezel or third layer 114 defines at least one opening or slot 150 configured to receive one or more of the anchoring features 130. In the illustrated arrangement, the bezel or third layer 114 includes an opening or slot 150 (identified by the arrows 151 in FIG. 3) associated with each of the attachment or anchoring features 130 of the knee cap 104. The openings or slots 150 can be defined by sewn edges or sewn connections between the third layer 114 and the second layer 112 between adjacent openings or slots 150. In other arrangements, the openings or slots 150 can be defined by any other suitable arrangement. The openings or slots 150 can be discrete from one another.

Figure 2:
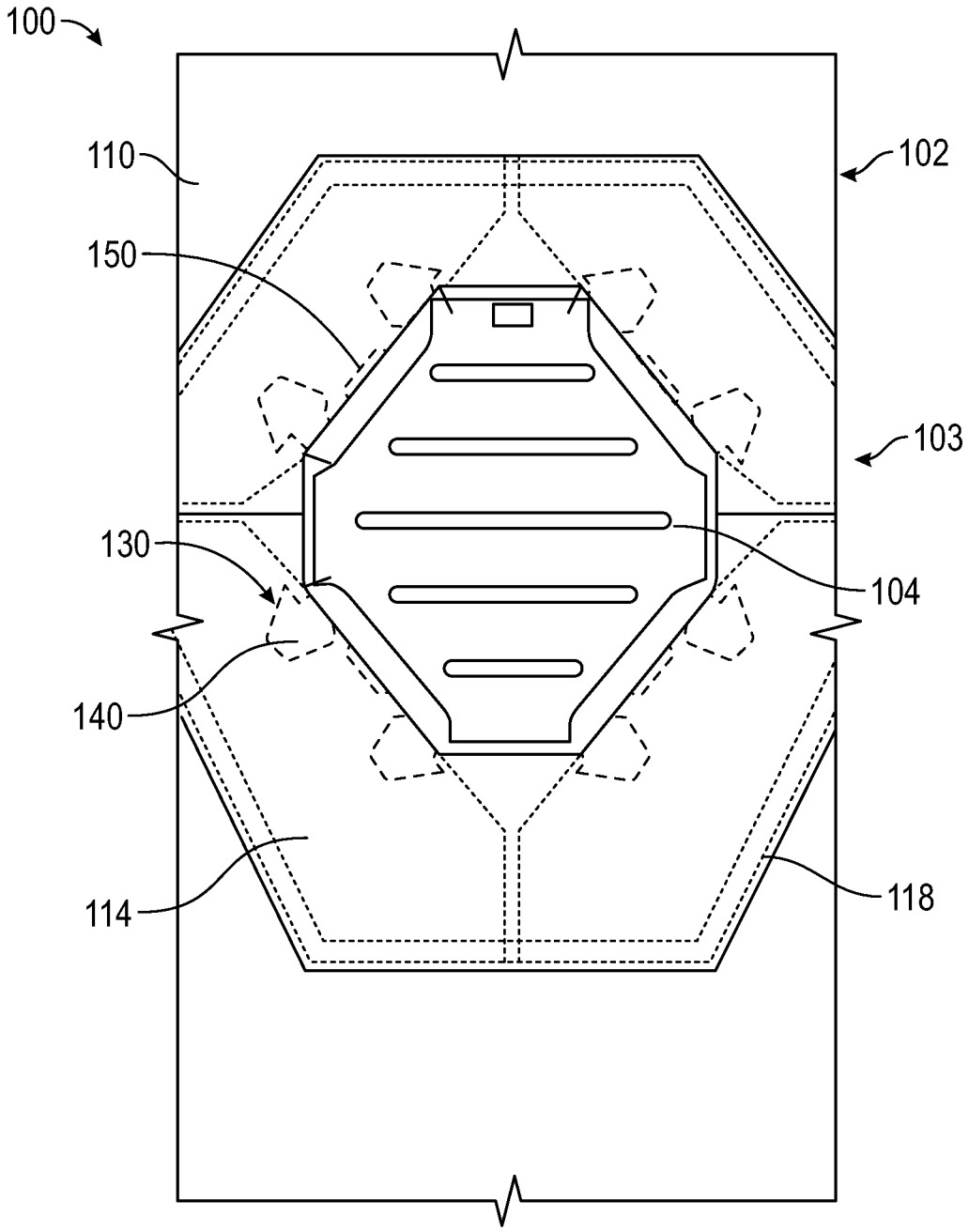
FIG. 2 is a front view of a knee portion of the pant of FIG. 1 illustrating the protective garment system in the form of a knee protection arrangement.

With reference to FIGS. 2 and 7, each of the attachment or anchoring features 130 is engaged with one of the openings or slots 150. Each of the attachment or anchoring features 130 defines a maximum width measured between the hooks 140, which is greater than a width of each of the openings or slots 150. As described above, the hooks 140 can be deflected toward one another to allow the attachment or anchoring feature 130 to be inserted into the opening or slot 150. In addition or in the alternative, the anchoring feature 130 can be introduced into the opening or slot 150 one hook 140 at a time. The resiliency of the material of the attachment or anchoring feature 130 can urge the hooks 140 apart from one another towards or to the relaxed position to secure the attachment or anchoring feature 130 within the opening or slot 150.

Although in the illustrated arrangement the number of opening or slots 150 is equal to the number of the attachment or anchoring features 130, in other arrangements these can differ in number. For example, the number of the openings or slots 150 can be greater than the number of the attachment or anchoring features 130 so that an orientation of the knee cap 104 (or other protective element) can be changed.

With reference to FIGS. 4 and 9-11, the knee pad 106 is received within a space or pocket 152 (see, e.g., FIGS. 9 and 11) defined between the first layer 110 and the second layer 112. One or more entries or openings 154 to the space can be provided at a suitable location or locations along the perimeter 118 of the second layer 112. Such entries 154 can be located inside the pant leg or inside the first layer 110 or can be located outside the pant leg or outside the first layer 110. In some configurations, there is a single entry 154 and the entry 154 is located at the bottom of the second layer 112.

Figure 11:
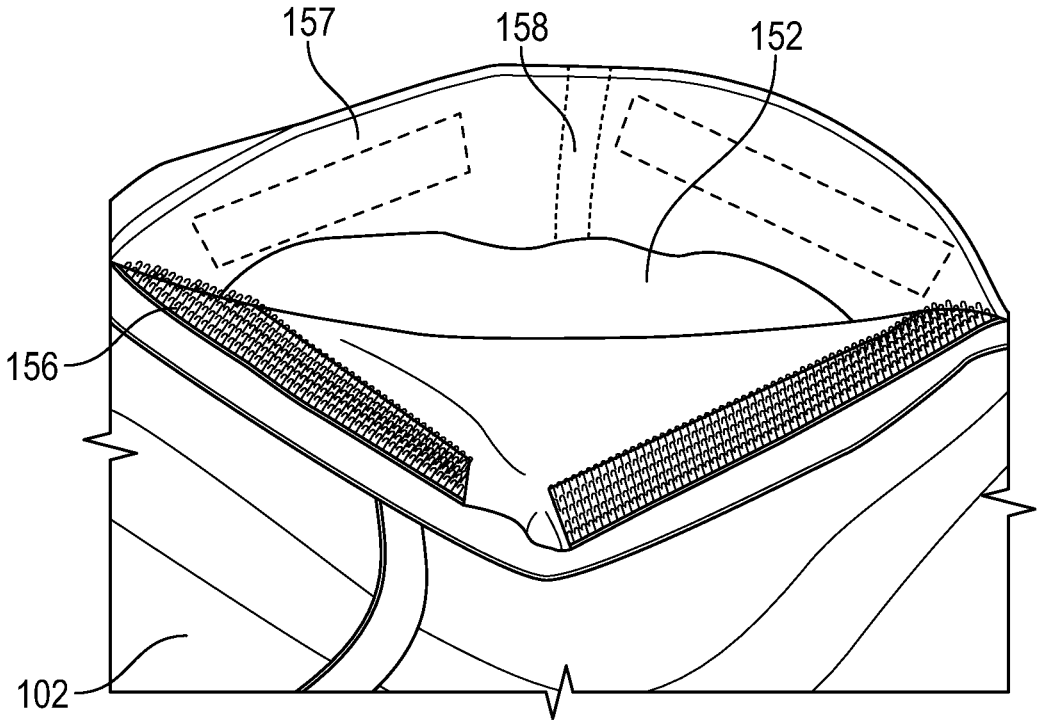
FIG. 11 is an enlarged view of the opening to the pocket illustrating a closure arrangement of the opening.

As illustrated in FIG. 8, the knee pad 106 has a maximum width that is greater than a width of the entry 154 to the pocket 152. The knee pad 106 can be folded along a longitudinal axis to permit the knee pad 106 to pass through the entry 154 and into the pocket 152, as illustrated in FIG. 10. A closure can be provided to close the entry 154. The closure can have two parts 156, 157 configured to selectively couple to one another. For example, the closure can be a hook and loop fastener having a first part 156 that engages the fabric of the opposing layer or an optional complementary part 157 of the hook and loop fastener. In other arrangements, other types of closures can be used, such as a zipper, buttons, snaps or other suitable arrangements. FIG. 11 illustrates an optional fold or flap 158 of fabric that assists retention/positioning of the knee pad 106 within the pocket or space.

The first layer 110, the second layer 112 and the third layer 114 discussed above refer to material layers of the garment. Each of the layers can be constructed from a single material or multiple materials. For example, in some configurations, one or more of the layers can be a composite layer. In some embodiments, the protective garment system 100 can include at least three protective layers. For example, the padded patella portion 122 can form a first protective layer. This first protective layer can be integrated (e.g., permanently integrated) with the garment base 102.

The knee pad 106 can form a second protective layer. This second protective layer can be removably engageable with the garment base 102 and can provide additional comfort and/or protection relative to the first protective layer. The knee cap 104 can form a third protective layer. This third protective layer can be removably engageable with the garment base 102 and can provide additional protection from irregular terrain or debris.

The third protective layer can provide a greater level of protection than the second protective layer and/or the first protective layer. The second protective layer can provide a greater level of protection than the first protective layer. Stated another way, the first (e.g., integrated) protective layer can provide an initial level of protection, which can be increased by the user with the addition of the second protective layer or the third protective layer, or both. With such an arrangement, the protective garment system 100 provides the user with a flexible system that can be adjusted to meet the actual or expected protection needs for a given activity. If three protective layers are provided and used, the protective garment system 100 can provide a greater level of protection in comparison to many currently available systems.

Figure 12A:
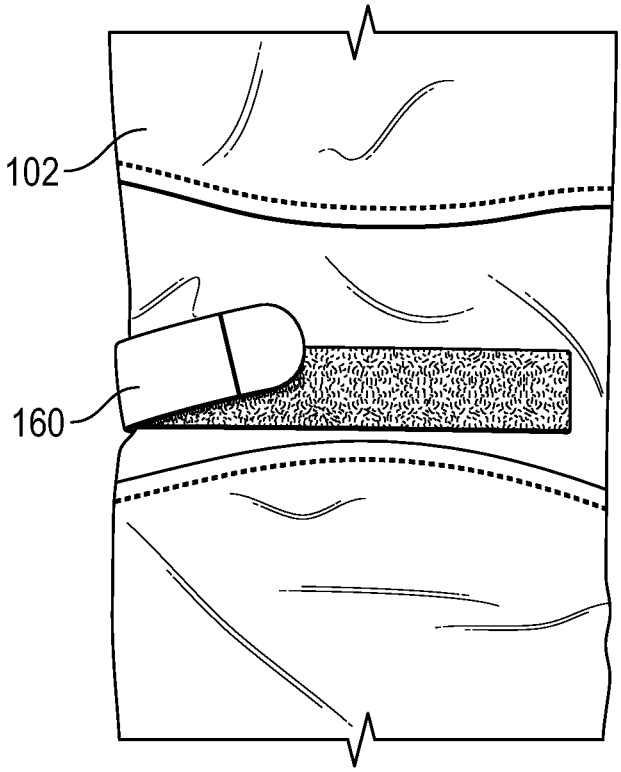
FIG. 12A is a rear view of a knee portion of the pant illustrating a circumferential adjustment arrangement in a first position and FIG. 12B is the circumferential adjustment arrangement in a second position.
Figure 12B:
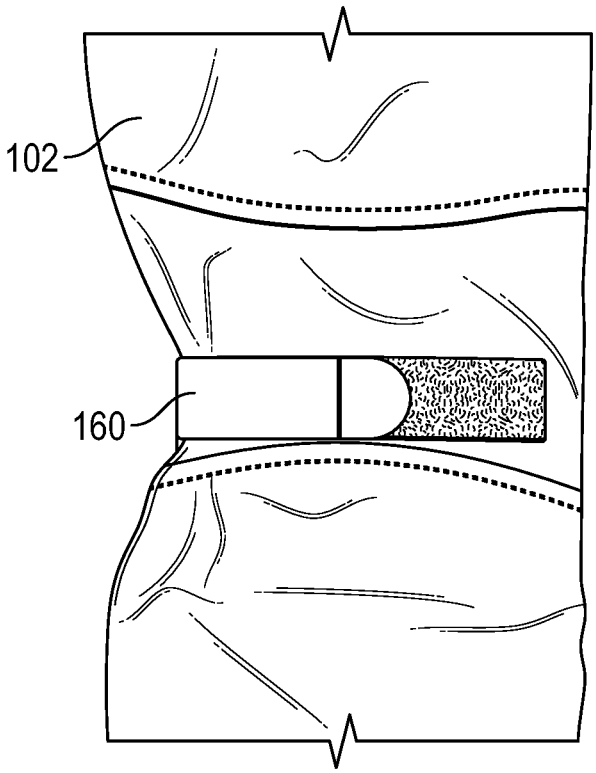

FIGS. 12A and 12B illustrate an adjustment feature of the garment. In particular, FIGS. 12A and 12B show an adjustment strap 160 that allows a circumference of the pant leg to be adjusted. In the illustrated arrangement, the strap 160 is located on the back of the knee portion of the pant 102, generally rearward of or rearward of the padded patella portion 122. The strap 160 can be adjusted by the user to establish a desired circumference of the knee portion of the pant to assist in keeping the protective elements 104, 106, 122 of the system 100 in the desired place on the user. The strap 160 can include a first element and a second element adjustably connectable by a hook-and-loop fastener, as illustrated, or another suitable fastener.

The pant 102 can, in addition or in the alternative, utilize a vertical adjustment feature to adjust a position of the protective elements 104, 106, 122 of the system 100 along a length of the pant. Such an arrangement can include one or more straps having a first element and a second element that are adjustably coupled to one another in a manner similar to the strap 160 except the strap(s) extend in a lengthwise direction of the pant leg.

Figures 13A, 13B:
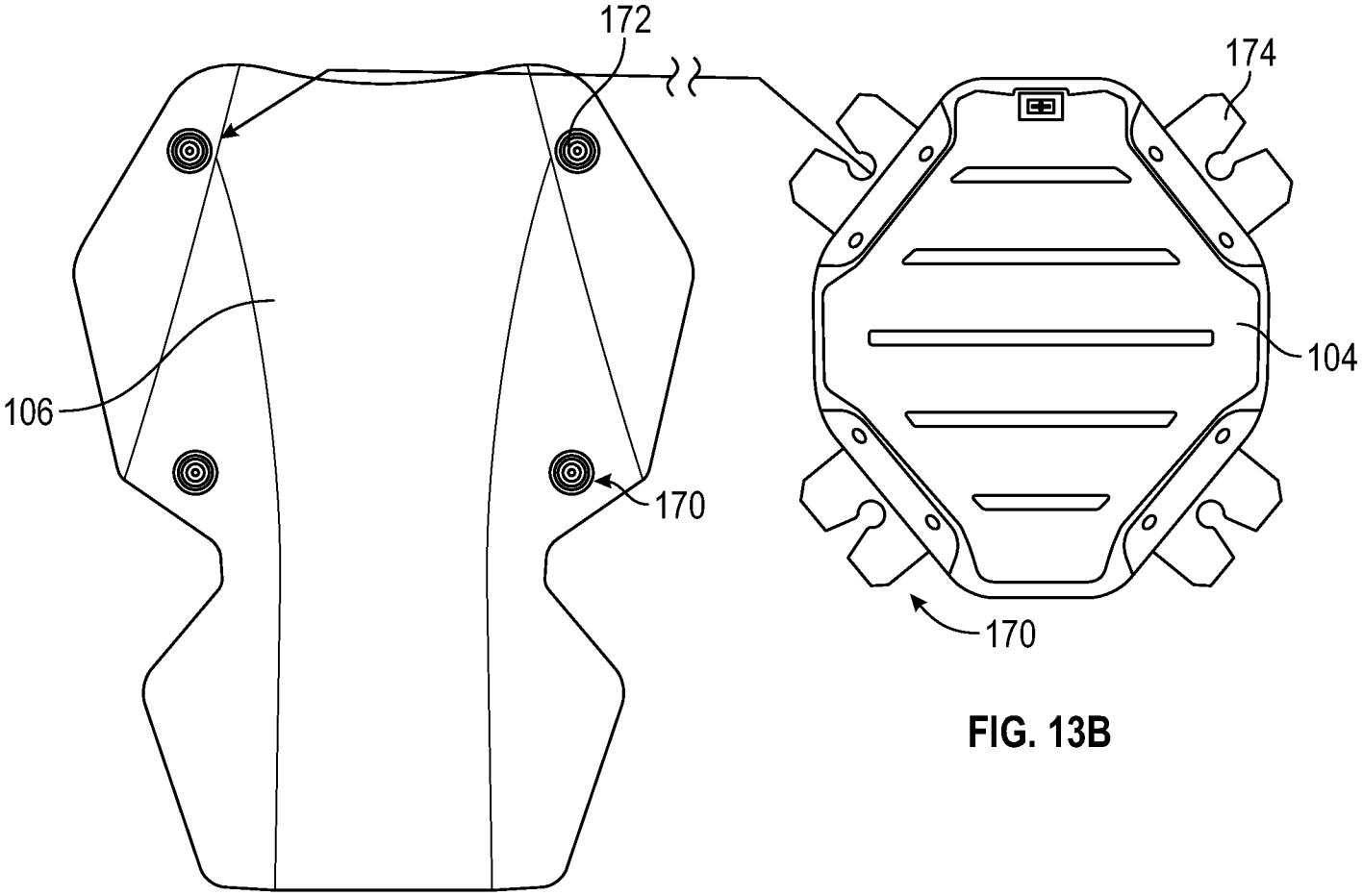
FIG. 13A is a front view of an alternative knee pad and FIG. 13B is a front view of an alternative knee cap illustrating a coupling arrangement between the knee pad and the knee cap.

FIGS. 13A and 13B illustrate an alternative arrangement for securing the knee cap 104 to the pant 102, either directly or indirectly. In the illustrated arrangement, the knee cap 104 is connectable directly to the knee pad 106 by a mechanical interlock arrangement, such as a post-and-clip coupling 170. The illustrated knee pad 106 includes a plurality (e.g., four) posts 172 that are each configured to engage a clip 174 of the knee cap 104 with a snap-fit engagement. However, this arrangement could also be reversed. Moreover, other numbers of couplings 170 can be provided. Such an arrangement may be advantageous for use with pants 102 that do not include a material layer (e.g., the second layer 112) between the knee cap 104 and the knee pad 106 such that direct access to the knee pad 106 is provided once the clips 174 are passed through the opening or slot 150.

Figures 14A, 14B:
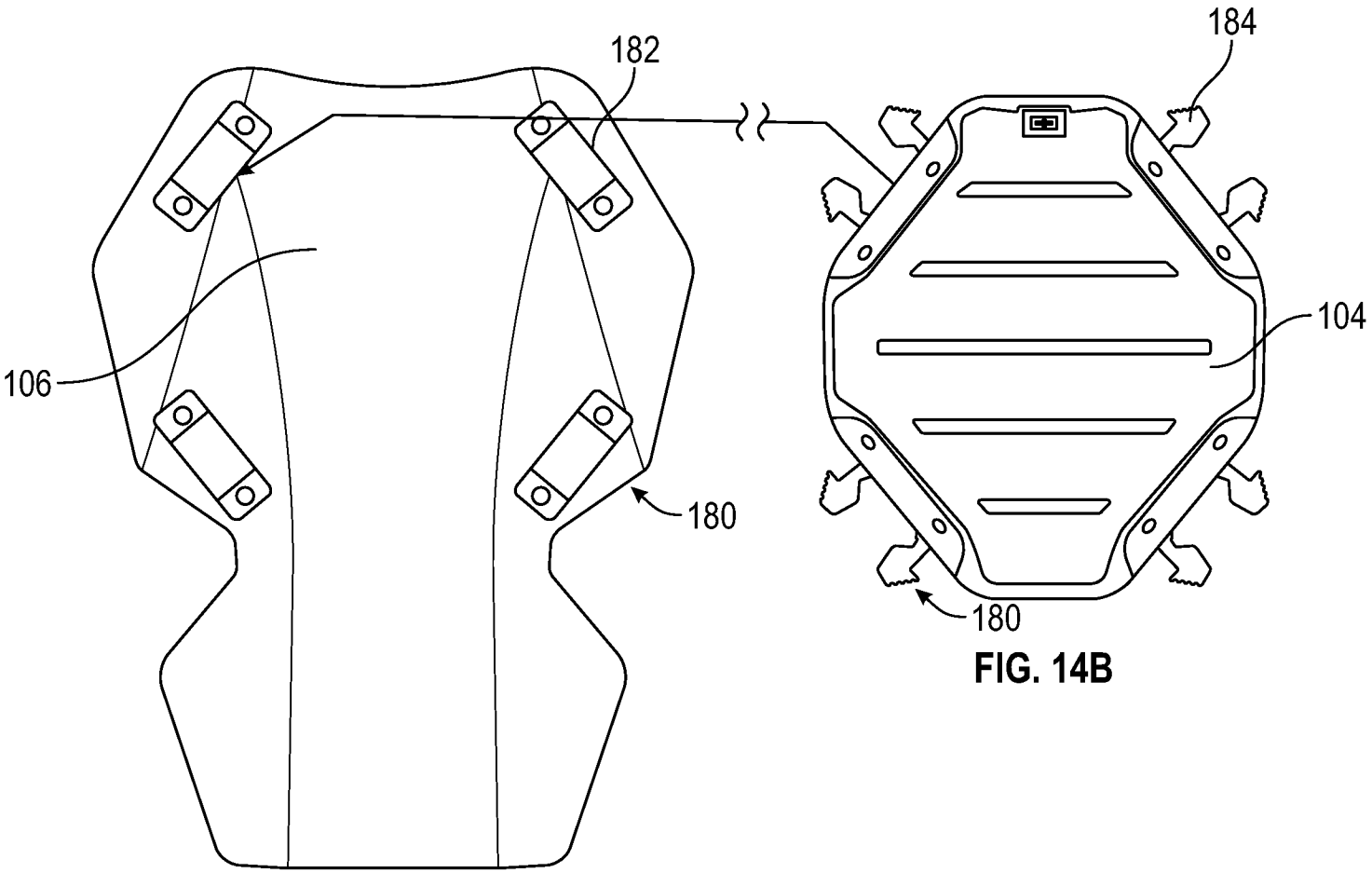
FIG. 14A is a front view of another alternative knee pad and FIG. 14B is a front view of a corresponding knee cap illustrating a coupling arrangement between the knee pad and the knee cap.

FIGS. 14A and 14B illustrate another alternative arrangement for securing the knee cap 104 to the pant 102, either directly or indirectly. In the illustrated arrangement, the knee cap 104 is connectable directly to the knee pad 106 by a mechanical interlock arrangement, such as a clip and receptacle coupling 180. The illustrated knee pad 106 includes a plurality (e.g., four) receptacles 182 that are each configured to engage with a clip 184 of the knee cap 104 with a snap-fit engagement. However, this arrangement could also be reversed. Moreover, other numbers of couplings 180 can be provided. The clips 184 in this arrangement are the same as or similar to the anchoring features 130 in the form of a pair of prongs or hooks 140 of FIGS. 1-11. The receptacles 182 define openings that function in a manner similar to the opening or slot 150 to receive the clips 184. Such an arrangement may be advantageous for use with pants 102 that do not include a material layer (e.g., the second layer 112) between the knee cap 104 and the knee pad 106 such that direct access to the knee pad 106 is provided once the clips 184 are passed through the opening or slot 150.

Figures 15A, 15B:
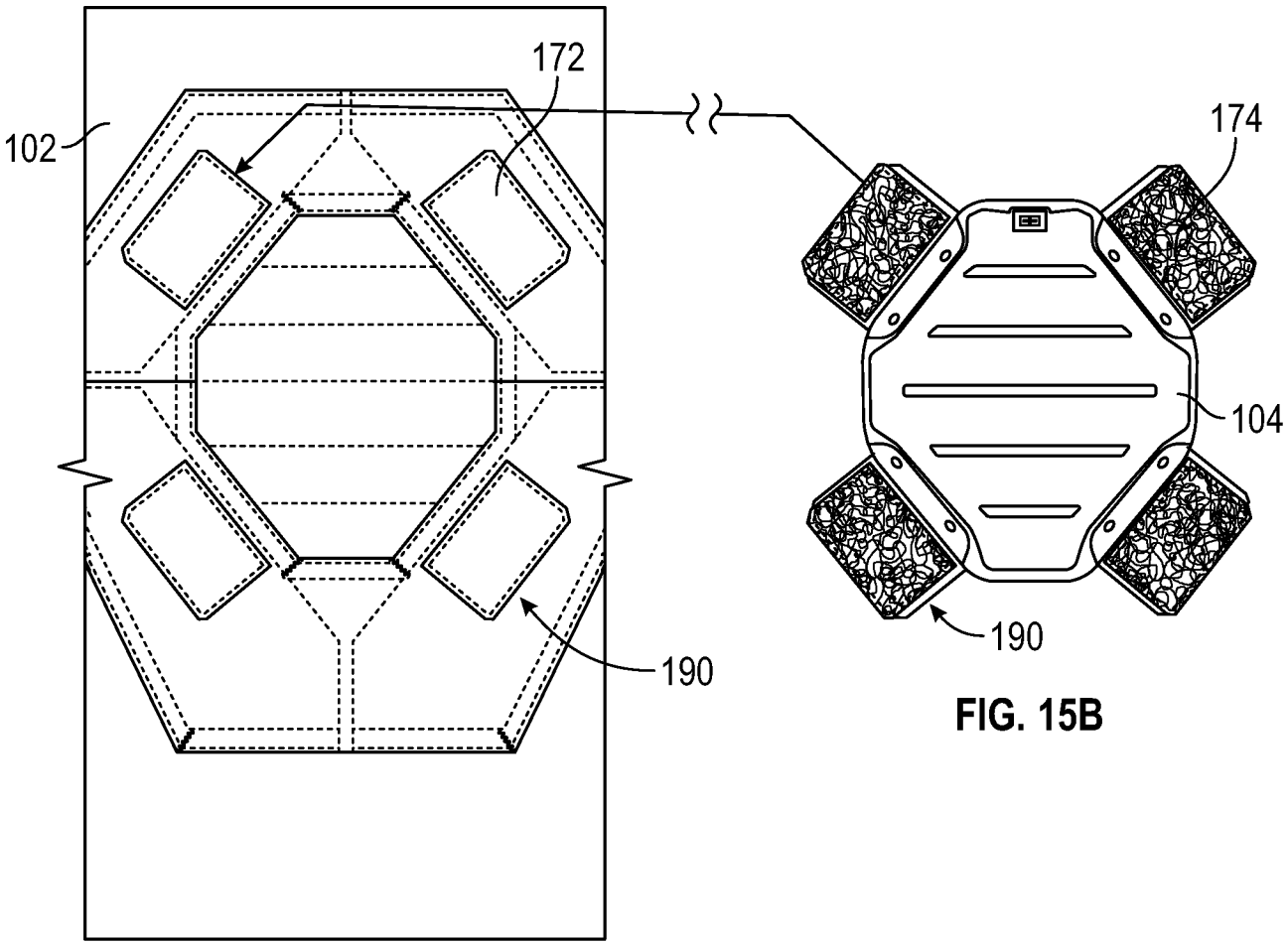
FIG. 15A is a front view of a knee portion of a pant and FIG. 15B is a front view of a corresponding knee cap illustrating a coupling arrangement between the pant and the knee cap.

FIGS. 15A and 15B illustrate yet another alternative arrangement for securing the knee cap 104 to the pant 102, either directly or indirectly. In the illustrated arrangement, the knee cap 104 is connectable directly to the pant 102 by a mechanical interlock arrangement, such as a hook and loop fastener 190. The illustrated knee pad 106 includes a plurality (e.g., four) radially-extending tabs 192 that each include a first part (e.g., a hook part) of the hook and loop fastener 190 configured to engage a pad 194 of the pant 102 that includes a second part (e.g., a loop part) of the hook and loop fastener 190. The pads 194 can be positioned on a rearward-facing surface of the third layer 114. However, this arrangement could also be reversed. Moreover, other numbers of couplings 190 can be provided. Such an arrangement may advantageously be used with pants 102 that include or do not include a material layer (e.g., the second layer 112) between the knee cap 104 and the knee pad 106.

Conclusion

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

What is claimed is:

1. A protective garment system, comprising:

a garment base comprising an external surface and a plurality of linear slots, each of the plurality of linear slots opening through the external surface of the garment base and into an interior space that is interior to the external surface, wherein each of the plurality of linear slots are separated from one another and are arranged around a perimeter of an area of the garment base that is to be protected; and at least a first protective element that is removably engageable with the garment base;

wherein the first protective element comprises a rigid cap and a plurality of anchors that are attached to the rigid cap and are configured to couple the first protective element in a removable manner relative to the garment base, wherein each of the plurality of anchors comprises a base portion and an engagement portion, wherein the base portion is coupled to the rigid cap and the engagement portion extends through an associated one of the plurality of linear slots when the first protective element is coupled to the garment base;

wherein, to couple the first protective element to the garment base, the engagement portion of each of the plurality of anchors is configured to pass from external the garment base, through the associated one of the plurality of linear slots, and into the interior space to engage the garment base interior to the external surface of the garment base, and wherein at least a portion of the garment base that defines the area to be protected and the plurality of linear slots comprises a flexible fabric.

2. The protective garment system of claim 1, wherein the engagement portion of each of the plurality of anchors comprises one or more hooks.

3. The protective garment system of claim 1, further comprising a second protective element that is a pad.

4. The protective garment system of claim 3, wherein the first protective element and the second protective element are separated by a layer of the garment base.

5. The protective garment system of claim 3, wherein the first protective element is directly coupled to the second protective element.

6. A protective garment system, comprising:

a garment base comprising an external surface; and a plurality of linear slots, each of the plurality of linear slots opening through the external surface of the garment base and into a space that is interior to the external surface, wherein each of the plurality of linear slots are separate from one another;

a first protective element that is removably engageable with the garment base, the first protective element comprising a rigid cap and a plurality of anchors, wherein each of the plurality of anchors comprises a base portion coupled to the rigid cap and an engagement portion that extends from the base portion; and a second protective element that is removably engageable with the garment base;

wherein, to couple the first protective element to the garment base, the engagement portion of each of the plurality of anchors is configured to pass from external the garment base, through an associated one of the plurality of linear slots, and into the interior space to engage the garment base interior to the external surface of the garment base;

wherein the second protective element is removably engageable with the garment base separately from the first protective element, and wherein at least a portion of the garment base that defines the area to be protected and the plurality of linear slots comprises a flexible fabric.

7. The protective garment system of claim 6, wherein the engagement portion of each of the plurality of anchors comprises one or more hooks.

8. The protective garment system of claim 6, wherein the plurality of anchors of the first protective element engages the plurality of linear slots of the garment base at discrete regions of a perimeter of the first protective element.

9. The protective garment system of claim 6, wherein the second protective element is a pad.

10. The protective garment system of claim 6, wherein the first protective element and the second protective element are separated by a layer of the garment base.

11. The protective garment system of claim 2, wherein the one or more hooks comprises a first hook and a second hook, wherein the first hook is separated a first distance from the second hook.

12. A protective garment system, comprising:

a garment base comprising an external surface; and a plurality of linear slots, each of the plurality of linear slots opening through the external surface of the garment base and into an interior space that is interior to the external surface, wherein each of the plurality of linear slots are separated from one another and are arranged around a perimeter of an area of the garment base that is to be protected; and at least a first protective element that is removably engageable with the garment base;

wherein the first protective element comprises a rigid cap and a plurality of anchors that are attached to the rigid cap and are configured to couple the first protective element in a removable manner relative to the garment base, wherein each of the plurality of anchors comprises a base portion and an engagement portion, wherein the base portion is coupled to the rigid cap and the engagement portion extends through an associated one of the plurality of linear slots when the first protective element is coupled to the garment base;

wherein, to couple the first protective element to the garment base, the engagement portion of each of the plurality of anchors is configured to pass from external the garment base, through the associated one of the plurality of linear slots, and into the interior space to engage the garment base interior to the external surface of the garment base, wherein the engagement portion of each of the plurality of anchors comprises one or more hooks, wherein the one or more hooks comprises a first hook and a second hook, wherein the first hook is separated a first distance from the second hook, wherein the first distance is greater than the width of the linear slot of the garment base.

13. The protective garment system of claim 2, wherein the one or more hooks are configured to be inserted into the linear slot one hook at a time.

14. The protective garment system of claim 7, wherein the one or more hooks comprises a first hook and a second hook, wherein the first hook is separated a first distance from the second hook.

15. The protective garment system of claim 14, wherein the first distance is greater than a second distance, where the second distance is defined as a width of the linear slot of the garment base.

16. The protective garment system of claim 7, wherein the one or more hooks are configured to be inserted into the linear slot one hook at a time.

17. The protective garment system of claim 1, wherein the garment base comprises a pair of layers that at least partially overlap one another, and wherein each of the plurality of linear slots is defined by an opening between the pair of layers and each of the plurality of linear slots is separated from one another by a connection between the pair of layers.

18. The protective garment system of claim 17, wherein the garment base is a pant leg and the first protective element is positioned on a knee of the pant leg.

19. The protective garment system of claim 6, wherein the garment base comprises a pair of layers that at least partially overlap one another, and wherein each of the plurality of linear slots is defined by an opening between the pair of layers and each of the plurality of linear slots is separated from one another by a connection between the pair of layers.

20. The protective garment system of claim 19, wherein the garment base is a pant leg and the first protective element is positioned on a knee of the pant leg.

21. The protective garment system of claim 1, wherein the perimeter of an area of the garment base that is to be protected is an octagon and each of the plurality of linear slots is adjacent to a side of the octagon.

22. The protective garment system of claim 21, wherein the plurality of linear slots are adjacent to every other one of the sides of the octagon.

* * * * *